US006082474A

United States Patent [19]

Matthias

[11] Patent Number: 6,082,474

[45] Date of Patent: Jul. 4, 2000

[54] ELEMENTS FACED WITH SUPERHARD MATERIAL

[75] Inventor: Terry R. Matthias, Upton St. Leonards, United Kingdom

[73] Assignee: Camco International Limited, Stonehouse, United Kingdom

[21] Appl. No.: 09/097,626

[22] Filed: Jun. 16, 1998

Related U.S. Application Data

[63] Continuation-in-part of application No. 09/008,051, Jan. 16, 1998, Pat. No. 6,011,232.

[30] Foreign Application Priority Data

Jul. 26, 1997 [GB] United Kingdom ..... 9715771
Jun. 1, 1998 [GB] United Kingdom ..... 9811560

[51] Int. Cl.[7] ..... E21B 10/46

[52] U.S. Cl. ..... 175/432

[58] Field of Search ..... 175/425, 428, 175/432, 434

[56] References Cited

U.S. PATENT DOCUMENTS

| | | | |
|---|---|---|---|
| 4,784,023 | 11/1988 | Dennis . | |
| 5,120,327 | 6/1992 | Dennis . | |
| 5,351,772 | 10/1994 | Smith . | |
| 5,590,728 | 1/1997 | Matthias et al. | 175/432 |
| 5,709,279 | 1/1998 | Dennis . | |
| 5,788,001 | 8/1998 | Matthias et al. | 175/432 |
| 5,888,619 | 3/1999 | Griffin | 428/172 |

FOREIGN PATENT DOCUMENTS

| | | |
|---|---|---|
| 0638383 | 2/1995 | European Pat. Off. . |
| 0655549 | 5/1995 | European Pat. Off. . |
| 0687797 | 12/1995 | European Pat. Off. . |
| 0688937 | 12/1995 | European Pat. Off. . |
| 0738823 | 10/1996 | European Pat. Off. . |
| 0764760 | 3/1997 | European Pat. Off. . |
| 2275068 | 8/1994 | United Kingdom . |
| 2283772 | 5/1995 | United Kingdom . |
| 2283773 | 5/1995 | United Kingdom . |
| 2305449 | 4/1997 | United Kingdom . |
| 9715771 | 7/1997 | United Kingdom . |

*Primary Examiner*—Geoffrey S. Evans
*Attorney, Agent, or Firm*—Jeffrey E. Daly

[57] ABSTRACT

A preform element, such as a preform cutting element for a rotary drag-type drill bit, includes a facing table of polycrystalline diamond having a front face, a peripheral surface, and a rear surface bonded to the front surface of a tungsten carbide substrate. The front surface of the substrate is formed with a plurality of recesses into which extend corresponding projections formed on the rear surface of the facing table. The recesses include at least one rebate which extends around only a part of the periphery of the substrate and into which extends a projection on the facing table which provides a part of the peripheral surface of the facing table.

32 Claims, 3 Drawing Sheets

ELEMENTS FACED WITH SUPERHARD MATERIAL

CROSS-REFERENCE TO RELATED APPLICATION

This is a Continuation-in-Part of U.S. patent application Ser. No. 09/008,051, filed Jan. 16, 1998, by Terry R. Matthias, entitled "Improvements In Or Relating To The Manufacture of Elements Faced With Superhard Material" now U.S. Pat. No. 6,011,232.

BACKGROUND OF THE INVENTION

1. Field of the Invention

The invention relates to elements faced with superhard material, and particularly to preform elements comprising a facing table of superhard material having a front face, a peripheral surface, and a rear surface bonded to a substrate of material which is less hard than the superhard material.

2. Description of Related Art

Preform elements of this kind are often used as cutting elements on rotary drag-type drill bits, and the present invention will be particularly described in relation to such use. However, the invention is not restricted to cutting elements for this particular use, and may relate to preform elements for other purposes. For example, elements faced with superhard material, of the kind referred to, may also be employed in workpiece-shaping tools, high pressure nozzles, wire-drawing dies, bearings and other parts subject to sliding wear, as well as elements subject to percussive loads as may be the case in tappets, cams, cam followers, and similar devices in which a surface of high wear resistance is required.

Preform elements used as cutting elements in rotary drill bits usually have a facing table of polycrystalline diamond, although other superhard materials are available, such as cubic boron nitride. The substrate of less hard material is often formed from cemented tungsten carbide, and the facing table and substrate are bonded together during formation of the element in a high pressure, high temperature forming press. This forming process is well known and will not be described in detail.

Each preform cutting element may be mounted on a carrier in the form of a generally cylindrical stud or post received in a socket in the body of the drill bit. The carrier is often formed from cemented tungsten carbide, the surface of the substrate being brazed to a surface on the carrier, for example by a process known as "LS bonding". Alternatively, the substrate itself may be of sufficient thickness as to provide, in effect, a cylindrical stud which is sufficiently long to be directly received in a socket in the bit body, without being brazed to a carrier. The bit body itself may be machined from metal, usually steel, or may be moulded using a powder metallurgy process.

Such cutting elements are subjected to extremes of temperature during formation and mounting on the bit body, and are also subjected to high temperatures and heavy loads when the drill is in use down a borehole. It is found that as a result of such conditions spalling and delamination of the superhard facing table can occur, that is to say the separation and loss of the diamond or other superhard material over the cutting surface of the table.

This may also occur in preform elements used for other purposes, and particularly where the elements are subjected to repetitive percussive loads, as in tappets and cam mechanisms.

Commonly, in preform elements of the above type the interface between the superhard table and the substrate has usually been flat and planar. However, particularly in cutting elements for drill bits, attempts have been made to improve the bond between the superhard facing table and the substrate by configuring the rear face of the facing table so as to provide a degree of mechanical interlocking between the facing table and substrate.

One such arrangement is shown in U.S. Pat. No. 5,120,327 where the rear surface of the facing table is integrally formed with a plurality of identical spaced apart parallel ridges of constant depth. The facing table also includes a peripheral rim of greater thickness, the extremities of the parallel ridges intersecting the surrounding ring. U.S. Pat. No. 4,784,023 illustrates a similar arrangement but without the peripheral ring. Other configurations of the rear face of the facing table are described in British Patent Specifications Nos. 2283772 and 2283773.

Although such arrangements have improved the bond between the superhard facing table and the substrate and have reduced the incidence of spalling and delamination, these effects still occur particularly where the preform elements are liable to be subject to impact conditions.

Hitherto, it has been considered advantageous to provide in the substrate of each element a peripheral rebate which extends around the whole of the periphery of the substrate so as to provide a corresponding continuous peripheral wall or rim of superhard material extending around the periphery of the facing table and overlapping the periphery of the substrate, as shown in above-mentioned U.S. Pat. No. 5,120,327.

SUMMARY OF THE INVENTION

According to the present invention the surprising discovery has been made that spalling and delamination is less likely to occur if such a wall or rim extends around only a part of the periphery of the preform element, or is interrupted so as to provide a plurality of shorter wall or rim parts spaced apart around the periphery of the cutting element. Such arrangements may provide advantage with any configuration of other recesses and projections at the interface between the facing table and substrate.

According to one aspect of the invention, therefore, there is provided a preform element including a facing table of superhard material having a front face, a peripheral surface, and a rear surface bonded to the front surface of a substrate which is less hard than the superhard material, the front surface of the substrate being formed with a plurality of recesses into which extend corresponding projections formed on the rear surface of the facing table, said recesses including at least one rebate which extends along only a part of the periphery of the substrate and into which extends a projection on the facing table which provides a part of the peripheral surface of the facing table.

Although only a single rebate may be provided, there might also be provided two or more of such rebates spaced apart along the periphery of the substrate. For example, said rebates may be of substantially equal length and may be substantially equally spaced apart along the periphery of the substrate.

The or each rebate may be of substantially constant width as measured from the periphery of the substrate transverse to the length of the rebate.

Alternatively, the rebate may vary in width as it extends along a part of the periphery of the substrate. For example, the rebate may have minimum width at each end thereof and a maximum width at a location intermediate the ends thereof. The width of the rebate may vary smoothly and continuously between said minimum width and said maximum width.

The or each rebate may have a bottom wall and an inner wall. The bottom wall may be flat and may be generally parallel to said front surface of the substrate. The inner wall may extend generally at right angles to the front surface of the substrate, but is preferably inclined outwardly towards the periphery of the substrate as it extends away from the front surface of the substrate.

Alternatively, the or each rebate may be defined by a wall which extends continuously from the front surface of the substrate to the periphery thereof.

The aforesaid recesses in the front surface of the substrate may also include recesses of any other shape. For example, they may include a plurality of elongate grooves into which extend corresponding elongate ribs formed on the rear surface of the facing table.

At least some of said grooves may intersect one or more of said rebates extending along the periphery of the substrate.

At least some of said grooves may have central longitudinal axes which radiate from a common point. Said common point may lie at the centre of the substrate or may be spaced from the centre of the substrate. For example, said common point may lie on a line passing through the centre of the substrate and through one of said rebates at the periphery thereof.

Alternatively, at least some of said grooves may have longitudinal axes which extend inwardly away from the periphery of the substrate at an angle which is inclined at less than 90° to said periphery.

In any of the above arrangements at least some of said grooves may vary in width and/or depth along the length thereof. For example said grooves may increase in width and/or depth as they extend towards the periphery of the substrate.

Said grooves may extend up to the periphery of the substrate, so that the ends of the ribs of superhard material which extend into the grooves form part of the exposed peripheral surface of the facing table.

In any of the above arrangements there may be provided a transition layer between the superhard material and the less hard material, the transition layer comprising material having one or more properties which is intermediate the corresponding properties of the superhard and less hard materials.

In this case the transition layer may be regarded as forming part of the substrate or part of the facing table, depending on the configuration.

The invention also provides a preform element including a facing table of superhard material having a front face, a peripheral surface, and a rear surface bonded to the front surface of a substrate which is less hard than the superhard material, the front surface of the substrate being formed with two or more rebates spaced apart along the periphery of the substrate so that each rebate extends along only a part of said periphery, and into which rebates extend corresponding projections of superhard material formed on the rear surface of the facing table at the periphery thereof.

Said rebates may be substantially equally spaced apart along the periphery of the substrate. The peripheral length of each rebate is preferably greater than the peripheral spacing between adjacent rebates. Each rebate may be of substantially constant width as measured from the periphery of the substrate transverse to the length of the rebate.

Each rebate according to this aspect of the invention may have any of the characteristics referred to above of the rebates according to the first aspect of the invention.

According to a further aspect of the invention there is provided a preform element including a facing table of superhard material having a front face, a peripheral surface, and a rear surface bonded to the front surface of a substrate which is less hard than the superhard material, the front surface of the substrate being formed with at least one rebate which extends along only a part of the periphery of the substrate, and into which rebate extends a corresponding projection of superhard material formed on the rear surface of the facing table at the periphery thereof, said rebate being of substantially constant width as measured from the periphery of the substrate.

In some embodiments it may be preferable for the depth of the rebate to be no greater than five times the maximum thickness of the rest of the facing table, and more preferably no greater than three the maximum thickness of the rest of the facing table.

DETAILED DESCRIPTION OF THE PREFERRED EMBODIMENTS

Figure 1:
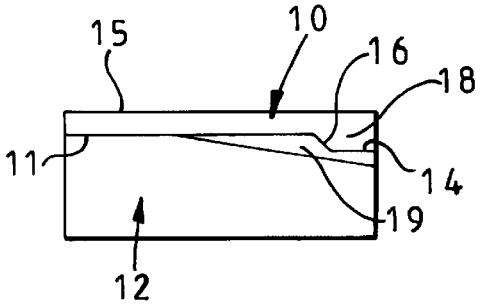
FIG. 1 is a section on the Line 1—1 of FIG. 2 through one form of preform element in accordance with the present invention.

FIG. 1 is a section through a preform element for use as a cutting element in a rotary drag-type drill bit. The arrangement and mounting of such cutting elements on a drill bit, as well as the general characteristics of such drill bits, are well known and will not therefore be described in detail. The present invention is concerned solely with the construction of each preform cutting element.

Referring to FIG. 1, the cutting element comprises a front facing table 10 of polycrystalline diamond or other superhard material, the rear surface 11 of which is bonded to the front face of a substrate 12 of less hard material, usually cemented tungsten carbide.

As is well known, the usual method of manufacturing such elements is first to form the substrate with an appropriate configuration on its front face and then to apply to the front face of the substrate a layer of polycrystalline diamond particles which fills the recesses in the front face. The assembly is then subjected to extremely high pressure and temperature in a press so that the diamond particles bond together to form the front facing table 10 and also bond to the substrate 12.

It is well known to configure the front face of the substrate with projections and recesses so that there is a degree of mechanical interlock between the front facing table and substrate so as to enhance the bond between them and therefore reduce the risk of delamination or spalling of the facing table.

As previously described, it is also common practice to form around the entire periphery of the substrate a continuous annular rebate so that when the diamond particles fill the rebate they create a solid peripheral wall or rim of diamond around the periphery of the facing table. This is not only believed to further enhance the bonding of the facing table to the substrate, but the increased thickness of the diamond at the peripheral cutting edge of the element is believed to enhance the element's resistance to impact.

According to the present invention, however, the substrate is formed with a rebate which extends around only a part of the periphery of the substrate so that the corresponding wall or rim of diamond formed on the facing table also extends only around a part of the periphery of the cutting element. As previously explained, this has surprisingly been found to enhance the resistance of the cutting element to spalling or delamination of the diamond table.

In the embodiment of FIG. 1, therefore, according to the invention, the circular substrate 12 is formed with a peripheral rebate 13 which extends around only a part of the periphery of the substrate 12. The rebate 13 has a flat bottom wall 14 which is parallel to the front surface 15 of the facing table 10 and an inclined inner wall 16. The inner wall 16 is arcuate and is of greater radius of curvature than the substrate 12 itself.

Also formed in the front surface of the substrate 12 are a series of elongate grooves 17 which extend from the interior of the surface to the part of the periphery of the substrate along which the rebate 13 is formed. The grooves 17 increase linearly in both width and depth as they extend outwardly towards the periphery of the substrate.

In the completed element, a peripheral wall or rim 18 is formed on the diamond table 10, projecting into the rebate 14 and thereby forming a thickened rim around a part of the periphery of the cutting element. Ribs 19 are also formed on the rear surface 11 of the facing table 10, projecting into the grooves 17 in the substrate.

In use the thickened rim 18 portion of the cutting element is used as the cutting edge of the element on the drill bit and thus the increased thickness of the facing table in this region enhances the impact resistance of the cutting edge which is further enhanced by the ends of the ribs 19 which are exposed at the periphery of the cutting element adjacent the cutting edge. It will be noted that, at the periphery, the ribs 19 are of greater depth than the partial rim 18. The partial rim 18 and ribs 19 also serve to enhance the bond between the facing table and substrate.

Figure 2:
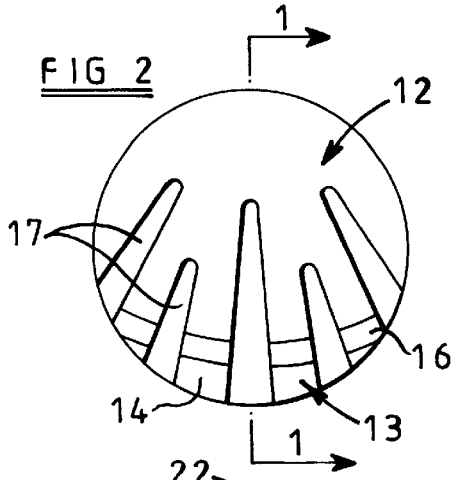
FIG. 2 is a plan view of the substrate of the element of FIG. 1, the facing table being omitted to show the configuration of the front face of the substrate.
Figure 3:
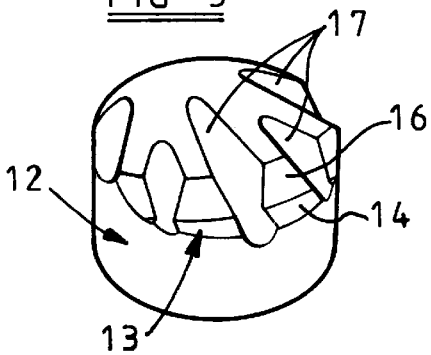
FIG. 3 is a perspective view of the substrate shown in FIG. 2.
Figure 4:
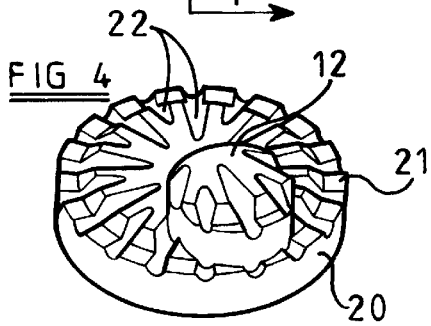
FIG. 4 is a perspective view showing how the substrate of FIGS. 2 and 3 maybe cut from an intermediate member.

As described in co-pending British Patent Application No. 9715771.3, a number of such substrates 12 may be formed from a single intermediate member, as shown in FIG. 4. The tungsten carbide intermediate member 20 has an annular rebate 21 extending around the whole periphery thereof and grooves 22 extending radially inwards from the periphery of the intermediate member. Circular substrates 12 are then cut, for example by electron discharge machining, from a portion of the intermediate member 20 adjacent the periphery and it will thus be seen that this produces a substrate of the kind shown in FIGS. 2 and 3.

Figure 5:
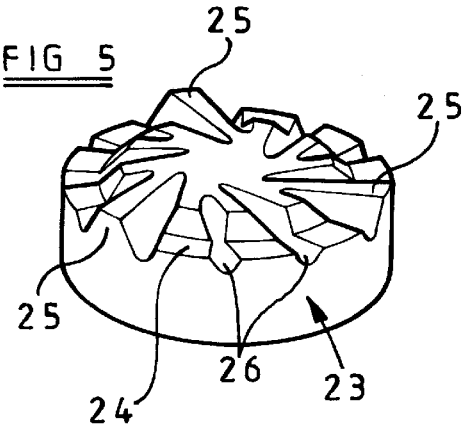
FIG. 5 is a perspective view of the substrate of an alternative embodiment of the invention.
Figure 6:
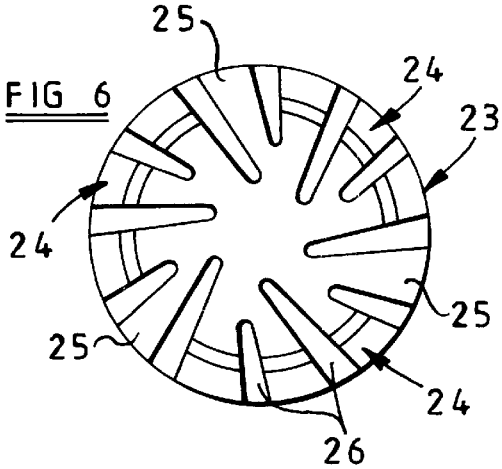
FIG. 6 is a plan view of the substrate of FIG. 5.

FIGS. 5 and 6 show in perspective and plan view the substrate of an alternative embodiment of preform cutting element according to the invention. In this case the tungsten carbide substrate 23 is formed with three rebates 24 which are equally spaced apart around the periphery of the substrate, the spacings between the rebates being indicated at 25. It will be seen that the length of each rebate 24 is greater than the peripheral spacing between adjacent rebates, and the rebates together extend around the majority of the periphery of the substrate. Generally it is preferred that the peripheral length of each rebate is at least more than twice its maximum width. Although three rebates are shown in this example, any greater number of rebates may be provided. However, it may be preferable for there to be no more than five rebates.

Grooves 26 extend inwardly from the periphery of the substrate and in this case the grooves 26 have longitudinal axes which are inclined at less than 90° to the periphery of the substrate. As best seen in FIG. 6, a groove 26 is formed at each end of each rebate 24.

As in the previous arrangement, in the finished cutting element the rebates 24 are each filled with a partial projecting rim or wall on the rear surface of the facing table which is applied to the substrate, and the grooves 26 are filled with outwardly extending ribs formed on the rear surface of the facing table. In this case also, the fact that each rebate extends around only a part of the periphery of the cutting element enhances the resistance of the element to spalling or delamination, as previously described, but since three separate rims are spaced apart around the periphery, the cutting element may be used in any orientation on the drill bit since any part of the periphery can serve as the cutting edge.

Figure 7:
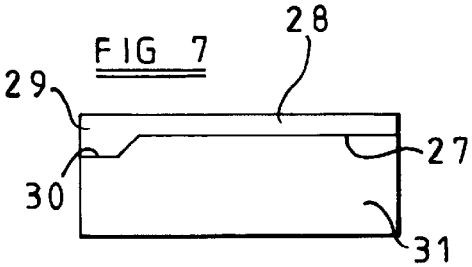
FIGS. 7–13 are sectional views through preform elements according to other embodiments of the invention.

FIG. 7 is a section through an alternative form of cutting element according to the invention where the rear surface 27 of the facing table 28 is flat apart from the partial rim 29 which projects into a rebate 30 in the substrate 31 which extends around only a part of the periphery of the substrate. The rebate 30 may extend around any portion of the periphery of the substrate and preferably extends around at least a third of the periphery. The rebate is of substantially constant width as in the arrangement of FIGS. 5 and 6, or may vary in width as in the arrangement of FIGS. 1–3 where the width of the rebate is a minimum at its ends and increases gradually to a maximum at a position between the ends of the rebate.

It will be appreciated that the partial rebate on the substrate and corresponding partial rim on the facing table may be of any desired cross-sectional shape and the rest of the interface between the substrate and facing table may be of any configuration. FIGS. 8–19 show, by way of further example, other configurations in accordance with the invention. FIGS. 8–13 are all sectional views of the cutting element.

Figure 8:
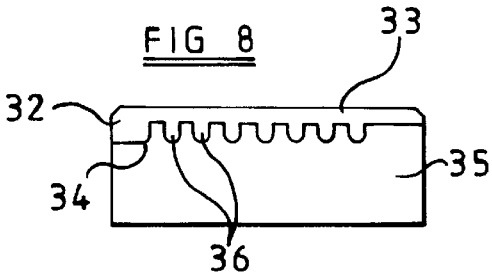

In the arrangement of FIG. 8 the partial rim 32 on the facing table 33 is generally rectangular in cross-section but has a curved inner edge 34. The front surface of the substrate 35 is formed with recesses into which extend corresponding projections 36 on the facing table 33. The recesses and projections 36 may be of any required configuration, for example the projections may comprise parallel ribs extending transversely across the cutting element, or concentric spaced circular ribs, or individual spaced circular domed protuberances formed on the underside of the facing table 33.

Figure 9:
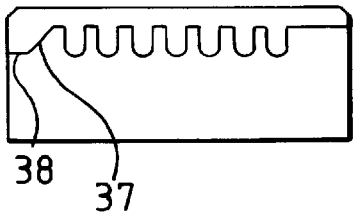

The arrangement of FIG. 9 is similar to that of FIG. 8 except that the inner wall 37 of the rebate 38 is inclined at greater than 90° to the bottom wall.

Figure 10:
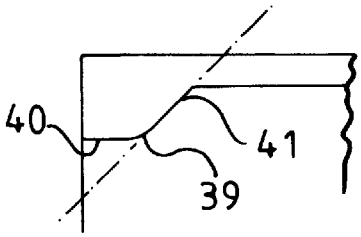

The arrangement of FIG. 10 is similar to that of FIG. 9 except that there is a curved bevel 39 between the flat bottom wall 40 and the inclined inner wall 41 of the rebate in the substrate.

Figure 11:
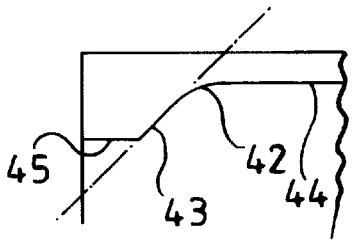

In the modified arrangement of FIG. 11 there is a smoothly curved junction 42 between the inclined inner wall 43 of the rebate in the substrate and the front surface 44 of the substrate. The bottom wall 45 of the rebate is again flat.

Figure 12:
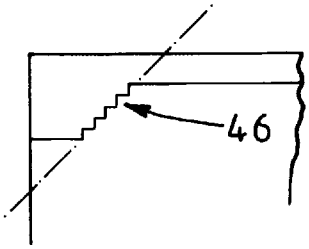

In the arrangement of FIG. 12 the inner wall 46 of the rebate in the substrate is stepped in cross-section.

Figure 13:
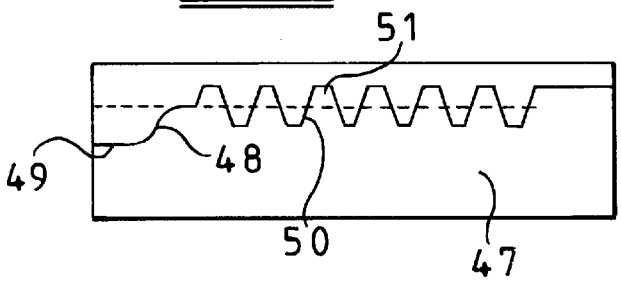

In the arrangement of FIG. 13, the partial rebate in the substrate 47 is smoothly curved in section there being a smoothly curved junction between the inclined inner wall 48 and the bottom wall 49 and between the inner wall 48 and the front surface of the substrate.

The front surface of the substrate is formed with tapered recesses 50 alternating with tapered projections 51. The recesses and projections 50, 51 may be elongate and extend in parallel arrays across the width of the cutting element, or they may comprise individual frusto-conical recesses and projections alternating in two dimensions across the area of the central region of the substrate.

Figure 14:
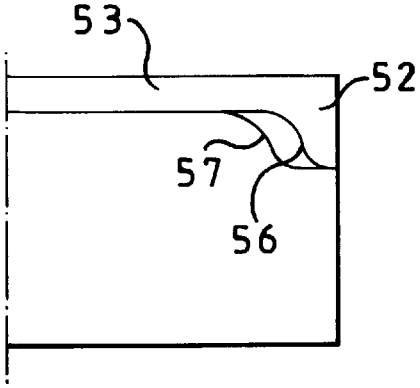
FIG. 14 is a half-section through another preform element in accordance with the invention.
Figure 15:
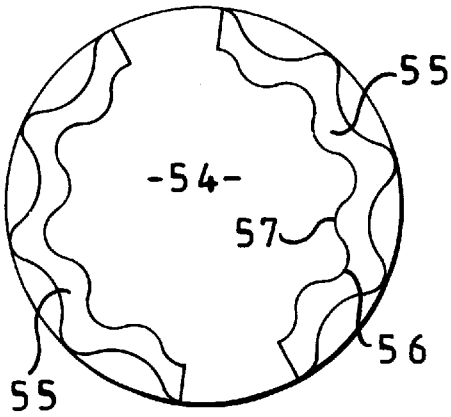
FIG. 15 is a plan view of the substrate of the embodiment of FIG. 14.

In the arrangement of FIGS. 14 and 15, the peripheral rim 52 of the facing table 53 varies in width periodically as it extends around part of the periphery of the facing table. As may be seen from FIG. 15, the front surface of the substrate 54 is formed with two rebates 55 which are spaced apart and each extend around part of the periphery of the substrate. The cross-sectional shape of each rebate 55 and partial rim 52 is generally in the form of part of a sine wave which varies from a minimum thickness indicated at 56 to a maximum thickness indicated at 57.

Figure 16:
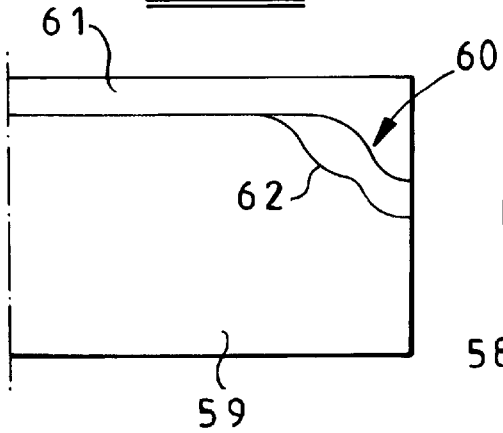
FIGS. 16 and 17 are similar views to FIGS. 14 and 15 of an alternative embodiment.
Figure 17:
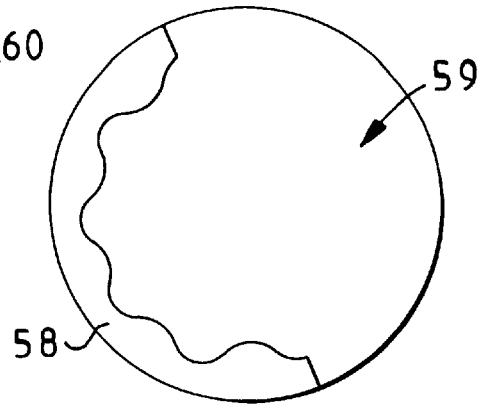

FIGS. 16 and 17 show a modified arrangement where there is provided only a single rebate 58 which extends around approximately half of the periphery of the substrate 59. In this case the rebate 58 and corresponding partial peripheral rim 60 on the facing table 61 vary in depth as well as in width, the portions 62 of greater width and depth having a double curved configuration as best seen in FIG. 16.

Figure 18:
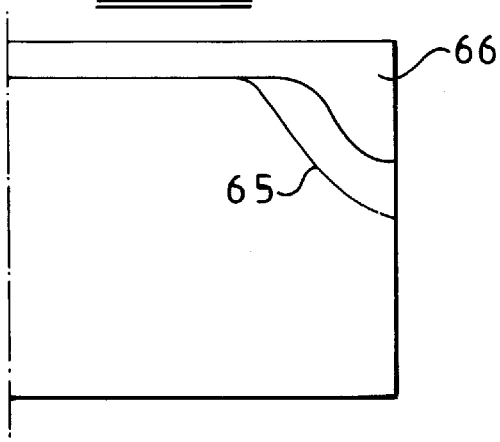
FIGS. 18 and 19 are similar views to FIGS. 14 and 15 of another embodiment.
Figure 19:
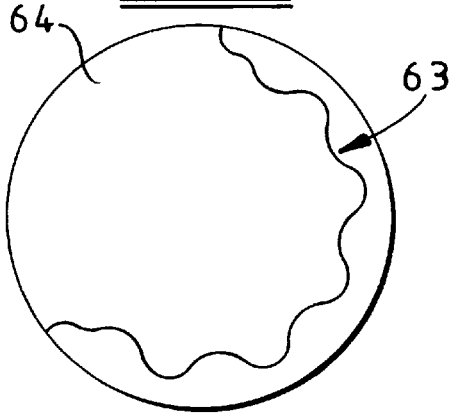

FIGS. 18 and 19 are somewhat similar to the arrangement of FIGS. 16 and 17 but in this case the single rebate 63 in the substrate 64 extends around more than half of the periphery of the substrate. Also the portions 65 of the rim 66 which are of greater width and depth have a cross-section in the form of a single smooth curve.

Figure 20:
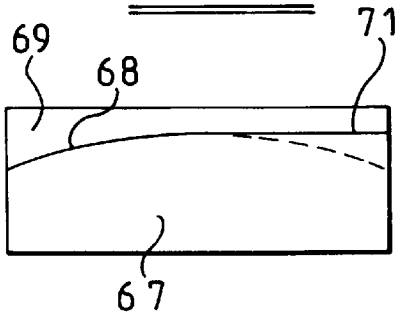
FIG. 20 is a section through a further preform element in accordance with the invention.

In each of the arrangements described above the front surface of the substrate comprises a generally flat central portion, with or without recesses in it, the peripheral rebates being clearly distinct from the central flat region. However, the invention is also applicable to arrangements where the peripheral rebates comprise the outer deepest portions of a continuously shaped front surface on the substrate, for example where the front surface of the substrate is generally convexly curved. Such an arrangement is shown in FIGS. 20 and 21 where the substrate 67 has a front surface 68 which is basically convexly domed so that the peripheral regions 69 of the facing table 70 are thicker than the central region of the facing table so as to provide a similar effect to the previously described arrangements where the facing table is formed with a distinct peripheral wall or rim.

In prior art arrangements where the substrate has a convexly curved surface, the surface is generally continuous over the whole area of the substrate and is the same in all diametral cross-sections, so that the effective peripheral rim extends around the whole periphery of the element. In accordance with the present invention, however, and as shown in FIGS. 20 and 21, the convexly curved front surface of the substrate 67 does not extend over the whole of the substrate but is interrupted by a number of angularly spaced lands 71, three such lands being provided in the arrangement shown in the drawings. The lands 71 on the substrate have the effect of making the peripheral rim on the facing table 70 discontinuous so as to provide, in effect, three circumferentially spaced rim portions 69.

Figure 21:
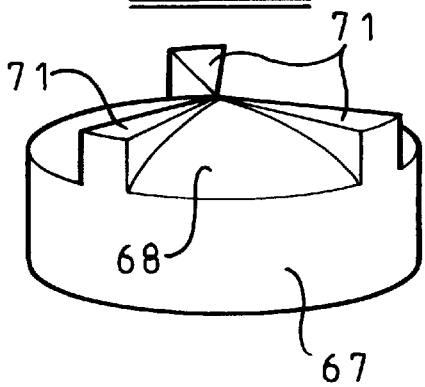
FIG. 21 is a perspective view of the substrate of the element shown in FIG. 20.

FIG. 21 is a perspective view of the substrate, without the facing table, to show clearly the shapes of the three rebates formed in the substrate.

The invention is also applicable to other arrangements where the front surface of the substrate is continuously shaped. For example, arrangements are possible where a convexly curved surface, similar to the surface 68, is formed with grooves or other kinds of recesses, for example concentric grooves. Also, instead of the front surface of the substrate being smoothly convex it may be of any other generally convex configuration.

It will be appreciated that the above configurations are by way of example only, and modifications may be made both the cross-sectional shape of the rebates and corresponding peripheral rims on the facing table, as well as to the configuration of the rest of the interface between the substrate and facing table.

Whereas the present invention has been described in particular relation to the drawings attached hereto, it should be understood that other and further modifications, apart from those shown or suggested herein, may be made within the scope and spirit of the present invention.

What is claimed:

1. A preform element including a facing table of superhard material having a front face, a peripheral surface, and a rear surface bonded to a front surface of a substrate which is less hard than the superhard material, the front surface of the substrate being formed with a plurality of recesses into which extend corresponding projections formed on the rear surface of the facing table, a plurality of grooves are formed in said recesses, at least one of said grooves extending to the periphery of the substrate, said recesses including at least one rebate which extends along only a part of the periphery of the substrate and into which extends a projection on the facing table which provides a part of the peripheral surface of the facing table, wherein said at least one rebate has a bottom wall and an inner wall wherein the bottom wall is flat and generally parallel to said front surface of the substrate.

2. A preform element according to claim 1, wherein there are provided at least two of such rebates spaced apart along the periphery of the substrate.

3. A preform element according to claim 2, wherein said rebates are of substantially equal length.

4. A preform element according to claim 2, wherein said rebates are substantially equally spaced apart along the periphery of the substrate.

5. A preform element according to claim 1, wherein said at least one rebate is of substantially constant width as measured from the periphery of the substrate transverse to the length of the rebate.

6. A preform element according to claim 1, wherein the rebate varies in width as it extends along a part of the periphery of the substrate.

7. A preform element according to claim 6, wherein the rebate has minimum width at each end thereof and a maximum width at a location intermediate the ends thereof.

8. A preform element according to claim 7, wherein the width of the rebate varies smoothly and continuously between said minimum width and said maximum width.

9. A preform element according to claim 1, wherein at least some of said grooves vary in depth along the length thereof.

10. A preform element according to claim 9, wherein said grooves increase in depth as they extend towards the periphery of the substrate.

11. A preform element according to claim 1, wherein the inner wall is inclined outwardly towards the periphery of the substrate as it extends away from the front surface of the substrate.

12. A preform element according to claim 1, wherein said at least one rebate is defined by a wall which extends continuously from the front surface of the substrate to the periphery thereof.

13. A preform element according to claim 1, wherein at least some of said grooves have longitudinal axes which extend inwardly away from the periphery of the substrate at an angle which is inclined at less than 90° to said periphery.

14. A preform element according to claim 1, wherein at least some of said grooves vary in width along the length thereof.

15. A preform element according to claim 14, wherein said grooves increase in width as they extend towards the periphery of the substrate.

16. A preform element according to claim 1, wherein at least some of said grooves have central longitudinal axes which radiate from a common point.

17. A preform element according to claim 16, wherein said common point lies at the centre of the substrate.

18. A preform element according to claim 16, wherein said common point is spaced from the centre of the substrate.

19. A preform element according to claim 18, wherein said common point lies on a line passing through the centre of the substrate and through one of said rebates at the periphery thereof.

20. A preform element according to claim 1, wherein said grooves extend up to the periphery of the substrate, so that the ends of the ribs of superhard material which extend into the grooves form part of the exposed peripheral surface of the facing table.

21. A preform element according to claim 1, wherein there is provided a transition layer between the superhard material and the less hard material, the transition layer comprising material having at least one property which is intermediate the corresponding property of the superhard and less hard materials.

22. A preform element including a facing table of superhard material having a front face, a peripheral surface, and a rear surface bonded to a front surface of a substrate which is less hard than the superhard material, the front surface of the substrate being formed with at least two rebates spaced apart along the periphery of the substrate so that each rebate extends along only a part of said periphery, and into which rebates extend corresponding projections of superhard material formed on the rear surface of the facing table at the periphery thereof, each of said rebates has a bottom wall and an inner wall wherein the bottom wall is flat and generally parallel to said front surface of the substrate and at least one groove is formed in the bottom wall of one of said rebates, said groove extending to the periphery of the substrate.

23. A preform element according to claim 22, wherein said rebates are substantially equally spaced apart along the periphery of the substrate.

24. A preform element according to claim 22, wherein the peripheral length of each rebate is greater than the peripheral spacing between adjacent rebates.

25. A preform element according to claim 22, wherein each rebate is of substantially constant width as measured from the periphery of the substrate transverse to the length of the rebate.

26. A preform element according to claim 22, wherein said rebates together extend around the majority of the periphery of the substrate, the regions between the rebates together extending around only a minor proportion of the periphery.

27. A preform element according to claim 22, wherein there are provided at least two and no more than five rebates spaced apart around the periphery of the substrate.

28. A preform element according to claim 22, wherein each rebate is elongate, the peripheral length of each rebate being more than twice the maximum width thereof.

29. A preform element according to claim 22, wherein said rebates comprise circumferentially spaced portions of a generally convex surface on the substrate, said portions being spaced apart by lands upstanding from said convex surface.

30. A preform element including a facing table of superhard material having a front face, a peripheral surface, and a rear surface bonded to a front surface of a substrate which is less hard than the superhard material, the front surface of the substrate being formed with a plurality of rebates which extend along only a part of the periphery of the substrate, and into which rebates extend a corresponding projection of superhard material formed on the rear surface of the facing table at the periphery thereof, each of said rebates being of substantially constant width as measured from the periphery of the substrate and having a bottom wall and an inner wall wherein the bottom wall is flat and generally parallel to said front surface of the substrate and at least one groove is formed in the bottom wall of one of said rebates, said groove extending to the periphery of the substrate.

31. A preform element according to claim 30, wherein the depth of the rebate is no greater than five times the maximum thickness of the rest of the facing table.

32. A preform element according to claim 30, wherein the depth of the rebate is no greater than three times the maximum thickness of the rest of the facing table.

* * * * *